US006490972B1

(12) United States Patent
Aoyama et al.

(10) Patent No.: US 6,490,972 B1
(45) Date of Patent: Dec. 10, 2002

(54) OFFSET PRINTER HAVING MECHANISM FOR MOVING INK ROLLERS INTO CONTACT WITH AND OUT OF CONTACT FROM PLATE CYLINDER

(75) Inventors: Hideo Aoyama, Fuchu (JP); Dong Liang, Fuchu (JP)

(73) Assignee: Ryobi, Ltd., Hiroshima-ken (JP)

( * ) Notice: Subject to any disclaimer, the term of this patent is extended or adjusted under 35 U.S.C. 154(b) by 201 days.

(21) Appl. No.: 09/631,955

(22) Filed: Aug. 3, 2000

(30) Foreign Application Priority Data

Aug. 3, 1999 (JP) ..... 11-220405

(51) Int. Cl.[7] ..... B41F 5/16; B41F 31/00

(52) U.S. Cl. ..... 101/177; 101/218; 101/211; 101/247; 101/350.1; 101/350.2; 101/351.1

(58) Field of Search ..... 101/177, 335, 101/349.1, 350.1, 350.2, 351.1, 351.2, 351.3, 351.4, 247, 206–210, 218

(56) References Cited

U.S. PATENT DOCUMENTS 1,025,258 A * 5/1912 Firm ..... 101/209
4,150,621 A * 4/1979 Raible ..... 101/209
5,161,462 A * 11/1992 Okamura et al. ..... 101/207
5,228,390 A * 7/1993 Jahn ..... 101/247

FOREIGN PATENT DOCUMENTS

JP 9-510410 10/1997 ..... B41F/7/10

* cited by examiner

*Primary Examiner*—Eugene H. Eickholt
(74) *Attorney, Agent, or Firm*—Sughrue Mion, PLLC

(57) ABSTRACT

An offset printer capable of contacting a plurality of ink rollers of a predetermined ink supply unit with a predetermined plate segment on a plate cylinder, and capable of out of contacting the ink rollers from a remaining plate segment on the plate cylinder. Roller support arms each supporting each ink roller are pivotally movably supported on a frame, and each support arm is moved by each, cam members pivotally movably supported on the frame. Each cam member is in contact with a center cam provided coaxially with and rotatable together with the plate cylinder, so that the ink rollers are successively moved. An interlocking mechanism including a lever is further provided. The lever moves concurrently the cam members to concurrently move the ink rollers.

15 Claims, 6 Drawing Sheets

OFFSET PRINTER HAVING MECHANISM FOR MOVING INK ROLLERS INTO CONTACT WITH AND OUT OF CONTACT FROM PLATE CYLINDER

BACKGROUND OF THE INVENTION

The present invention relates to an offset printer, and more particularly, to a multiple color offset printer in which a surface of a plate cylinder is divided into a plurality of regions to which inks of different colors are supplied.

Japanese Patent Application Publication No.9-510410 discloses an offset printer capable of performing offset printing with four different colors of inks. The printer includes a single impression cylinder, a single paper discharge mechanism, a single paper feed conveyer, a single transfer drum, two blanket cylinders, two plate cylinders and, ink rollers for the four colors. The paper feed conveyer and the transfer drum are adapted for delivering a paper to a surface of the impression cylinder. The paper is mounted on the surface of the impression cylinder. The paper discharge mechanism is adapted to discharge the paper from the impression cylinder. The blanket cylinder is pressed against the paper mounted on the impression cylinder.

The impression cylinder is rotated about its axis by a drive motor. Further, two blanket cylinders have their axes extending in a direction parallel with the axis of the impression cylinder, and the two blanket cylinders are in contact with the impression cylinder and are rotated upon rotation of the impression cylinder. The paper feed conveyer, the transfer drum and the paper discharge mechanism are also driven or rotated by the rotation of the impression cylinder.

Each plate cylinder has a peripheral surface provided with a thin plate where an image to be printed is formed. The two plate cylinders have their axes extending in a direction parallel with the axes of the blanket cylinders. Each plate cylinder is in contact with each blanket cylinder, and each plate cylinder is rotated upon rotation of each blanket cylinder. Each peripheral surface of the plate cylinder is divided into first and second regions. The first region is formed with an image with a single color of ink, and the second region is formed with an image with a different color of ink. Accordingly, the two plate cylinders form images of four colors of inks.

The ink roller is adapted for supplying an ink to the plate of the plate cylinder. To this effect, two ink rollers are provided in contact with each plate cylinder so that two different colored inks can be supplied to each plate. Accordingly, totally four ink rollers are provided for four different colors. Axes of the ink rollers extend in parallel with the axis of the plate cylinder. The ink rollers are rotated upon rotation of the plate cylinder.

If an intended color of ink is to be supplied to the first region on the surface of the plate cylinder, the plate cylinder and the ink roller of this color are rotated with the ink roller being in contact with the first region. During the rotation, the intended color is supplied from the ink roller to the first region.

In the conventional offset printer, a mechanism for accurately moving the ink roller into contact with or out of contact from the specific region on the surface of the plate cylinder has not been proposed. That is, no detailed arrangement or mechanism is proposed for bringing the ink roller into contact with the first plate region when the first plate region is circularly moved closed to or toward the ink roller carrying the intended ink color in accordance with the rotation of the plate cylinder, and for moving the ink roller away from the second plate region when the second plate region is circularly moved closed to the ink roller in accordance with further rotation of the plate cylinder.

SUMMARY OF THE INVENTION

It is therefore, an object of the present invention to provide an offset printer provided with a moving mechanism capable of bringing the ink roller provided in a predetermined ink supplying mechanism into contact with a specific plate region on the surface of the plate cylinder, and capable of moving the ink roller away from the different plate region on the surface of the identical plate cylinder.

This and other objects of the present invention will be attained by an offset printer including a frame, a plate cylinder, a plurality of ink supply units, and a moving mechanism. The plate cylinder is rotatably supported by the frame and has an outer peripheral surface sectioned into at least two plate segments extending between ends of the plate cylinder. Each of the ink supply units supplies a different colored ink. The ink supply units are provided in one-to-one correspondence with the plate segments, and each ink supply unit includes an ink roller contactable with its corresponding plate segment so that the at least two plate segments receive inks of different colors. The moving mechanism is provided for each ink supply unit and is supported on the frame and is connected to the ink roller of each ink supply unit for moving the ink roller into contact with the corresponding plate segment and for moving the ink roller out of contact from each non corresponding plate segment.

With this arrangement, a predetermined color of ink can surely be supplied to only a predetermined plate segment, and the supply of the predetermined color of ink to unwanted plate segment can surely be avoided.

Preferably, means for restraining excessive contacting pressure of the ink roller against the plate cylinder is provided. Further preferably, means for adjusting contacting pressure of the ink roller against the plate cylinder can be provided. Thus, a desirable contacting pressure can be provided.

Further, in the present invention, each ink supply unit includes at least two ink rollers including a first ink roller and a second ink roller, and preferably, the moving means includes different timing means for providing an out of contacting timing of the first ink roller from the corresponding plate segment different from an out of contact timing of the second ink roller from the corresponding plate segment, and for providing a contacting timing of the first ink roller with the corresponding plate segment different from a contact timing of the second ink roller with the corresponding plate segment.

With such an arrangement, each ink roller can be brought into contact with the plate cylinder when a leading edge of the corresponding plate segment reaches each ink roller, and can be moved out of contact from the plate cylinder when a trailing end of the corresponding plate segment reaches each ink roller. Accordingly, the corresponding plate segment can provide a uniform ink density over its entire area.

Further, the at least two plate segments preferably include a first plate segment having a semi-circular cross-section and a second plate segment having a remaining semi-circular cross-section, and the moving means further includes a first support arm, a second support arm, and the different timing means includes a first cam member, a second cam member and a generally circular center cam. The first support arm is pivotally movably supported on the frame and rotatably supports the first ink roller. Pivotal movement of the first support arm moves the first ink roller into contact with and out of contact from the plate cylinder. The second support arm is positioned spaced away from the first support arm in a circumferential direction of the plate cylinder. The second support arm is pivotally movably supported on the frame and rotatably supports the second ink roller. Pivotal movement of the second support arm moves the second ink roller into contact with and out of contact from the plate cylinder. The first cam member is pivotally movably supported on the frame and has one end contactable with the first support arm and another end provided with a first cam follower. Pivotal movement of the first cam member pivotally moves the first support arm. The second cam member is pivotally movably supported on the frame and has one end contactable with the second support arm and another end provided with a second cam follower. Pivotal movement of the second cam member pivotally moves the second support arm. The generally circular center cam is disposed coaxially with the plate cylinder and is positioned therebeside. The circular center cam includes a first radius cam face provided at a rotation phase equal to the first plate segment, and a second radius cam face having a radius different from the first radius and provided at a rotation phase equal to the second plate segment. The first and second cam followers are in successive rolling contact with the first radius cam face for successively contacting the first and second ink rollers with the first plate segment, and the first and second cam followers are in successive rolling contact with the second radius cam face for successively moving the first and second ink rollers out of contact from the second plate segment.

With this arrangement, contacting and out of contacting movement of the ink rollers relative to the plate cylinder can be determined by the generally circular center cam rotatable together with the plate cylinder. Therefore, accurate movement of the ink rollers results.

Further, preferably, each ink supply unit includes a plurality of ink rollers, and the offset printer further includes an interlocking mechanism for simultaneously moving the plurality of ink rollers out of contact from the corresponding plate segment in case of a stop of supply of ink to the corresponding plate segment, and for simultaneously moving the plurality of ink rollers toward the corresponding plate segment.

With this arrangement, the plurality of ink rollers can be simultaneously moved out of contact from the plate cylinder by the interlocking mechanism if ink supply to the plate cylinder is to be stopped. Therefore, it is unnecessary to provide an additional arrangement for driving the ink rollers to move out of contact from the plate cylinder. Thus, a resultant offset printer can provide a simple arrangement with the reduced mechanical parts.

DETAILED DESCRIPTION OF THE PREFERRED EMBODIMENTS

An offset printer according to one embodiment of the present invention will be described with reference to FIGS. 1 through 6.

General Arrangement

Figure 1:
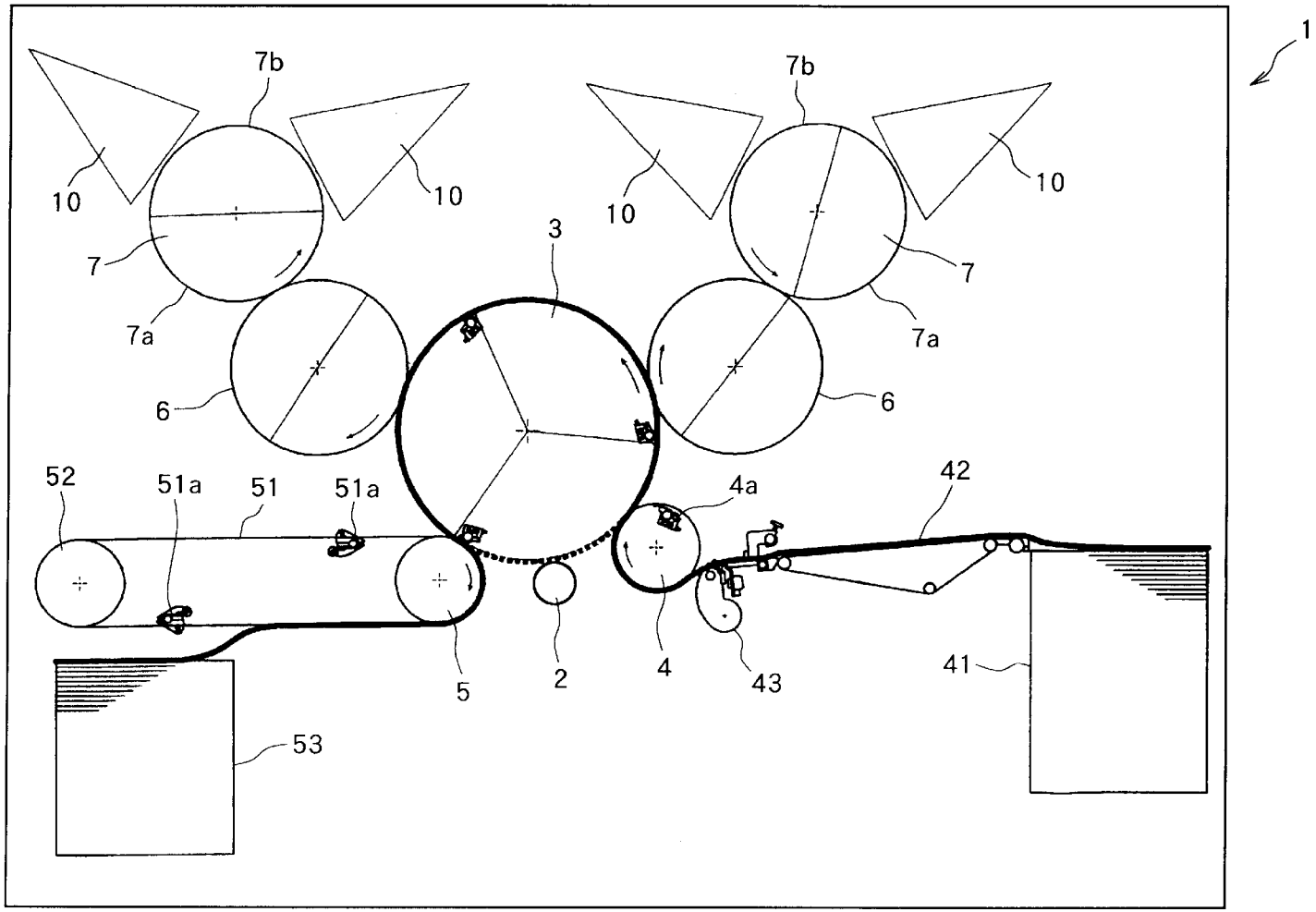
FIG. 1 is a schematic side view showing an offset printer according to one embodiment of the present invention.

FIG. 1 shows an entire arrangement of the offset printer 1. The offset printer 1 has a frame 11 (FIG. 5) to which a motor (not shown) is fixed. The motor has an output shaft (not shown) on which a drive gear 2 is mounted. The printer 1 also includes a generally cylindrical impression cylinder 3 having an impression cylinder gear (not shown) provided coaxially and integrally therewith. The drive gear 2 is meshedly engaged with the impression cylinder gear. Thus, the rotation of the motor is transmitted to the impression cylinder 3 through the drive gear 2 and the impression cylinder gear.

The printer 1 also includes a generally cylindrical paper feed cylinder 4 adapted for supplying a paper to a surface of the impression cylinder 3. A paper feed cylinder gear (not shown) is rotatably provided coaxially with the paper feed cylinder 4. The paper fed cylinder gear is meshedly engaged with the impression cylinder gear. The impression cylinder 3 and the paper feed cylinder 4 are rotated in surface contact with each other. A paper feed pile 41 is provided where a stack of papers are accommodated. A feeder board 42 and an infeed portion 43 are provided between the paper feed pile 41 and the paper feed cylinder 4. The feeder board 42 is in the form of a belt conveyer for delivering the paper from the paper feed pile 41 toward the paper feed cylinder 4. The infeed portion 43 is adapted for precisely and smoothly infeeding the paper to the paper feed cylinder 4. The infeed portion 43 is provided with a registration mechanism (not shown) including rollers for moving the paper to its correct position. A driving mechanism (not shown) driven by the rotation of the paper feed cylinder gear is provided in the registration mechanism for rotating the rollers. Further, the driving force of the feeder board 42 for moving the paper from the paper feed pile 41 to the infeed portion 43 is transmitted to the feeder board 42 from the driving mechanism of the registration mechanism. The paper feed cylinder 4 has a peripheral surface provided with a paper feed pawl 4*a* adapted for fixing the paper to the paper feed cylinder 4 and delivering the paper to the impression cylinder 3. The paper feed pawl 4*a* is movable in a circular path together with the rotation of the paper feed cylinder 4. A combination of the paper feed cylinder 4, the paper feed pawl 4*a*, the paper feed pile 41, the feeder board 42 and the infeed portion 43 constitutes a paper supplying mechanism.

A generally cylindrical paper discharge portion 5 is provided in contact with the impression cylinder 3 for discharging the paper from the surface of the impression cylinder 3. A paper discharge portion gear (not shown) in meshing engagement with the impression cylinder gear is provided coaxially and integrally with the paper discharge portion 5. Therefore, the paper discharge portion 5 is rotatable upon rotation of the impression cylinder 3. An endless chain 51 is mounted between the paper discharge portion 5 and a sprocket 52 spaced away from the paper discharge portion 5. A plurality of paper discharge grippers 51*a* are provided to the endless chain 51 so as to grip the paper on the impression cylinder 3 and to remove the paper therefrom. Below the sprocket 52, a paper discharge pile 53 is provided where each paper gripped and delivered by the gripper 51*a* and the endless chain 51 is stacked successively. The paper discharge portion 5, the endless chain 51, and the sprocket 52 are driven by the rotation force transmitted from the impression cylinder gear through the paper discharge portion gear. A combination of the paper discharge portion 5, the endless chain 51, the paper discharge grippers 51*a*, the sprocket 52, and the paper discharge pile 53 constitutes a paper discharge mechanism.

The offset printer 1 also includes two blanket cylinders 6 each in contact with the impression cylinder 3 and provided with blanket cylinder gear (not shown) provided coaxially and integrally with associated blanket cylinder 6. These blanket cylinder gears are in meshing engagement with the impression cylinder gear. During printing operation, the paper supplied to the surface of the impression cylinder 3 is pressed against the blanket cylinder 6 by the impression cylinder 3. The rotation force of the impression cylinder 3 is transmitted to the blanket cylinder 6 through the impression cylinder gear (not shown) and the blanket cylinder gear (not shown).

Two plate cylinders 7 are provided each in contact with each blanket cylinder 6 and each provided with a plate cylinder gear (not shown) coaxially and integrally with each plate cylinder 7. Each plate cylinder gear is in meshing engagement with each blanket cylinder gear (not shown). Thus the rotation force of the blanket cylinder 6 is transmitted to the plate cylinder 7 through the blanket cylinder gear (not shown) and the plate cylinder gear. Each surface of each plate cylinder 7 is sectioned into at least two plate segments extending between ends of the plate cylinder 7, for example, a first plate segment 7*a* where an image for a specific color is to be formed, and a second plate segment 7*b* where an image for a different color is to be formed. That is, one plate cylinder 7 forms two images with two different colors, and totally four images of four different colors are formed on the two plate cylinders 7.

Figure 2:
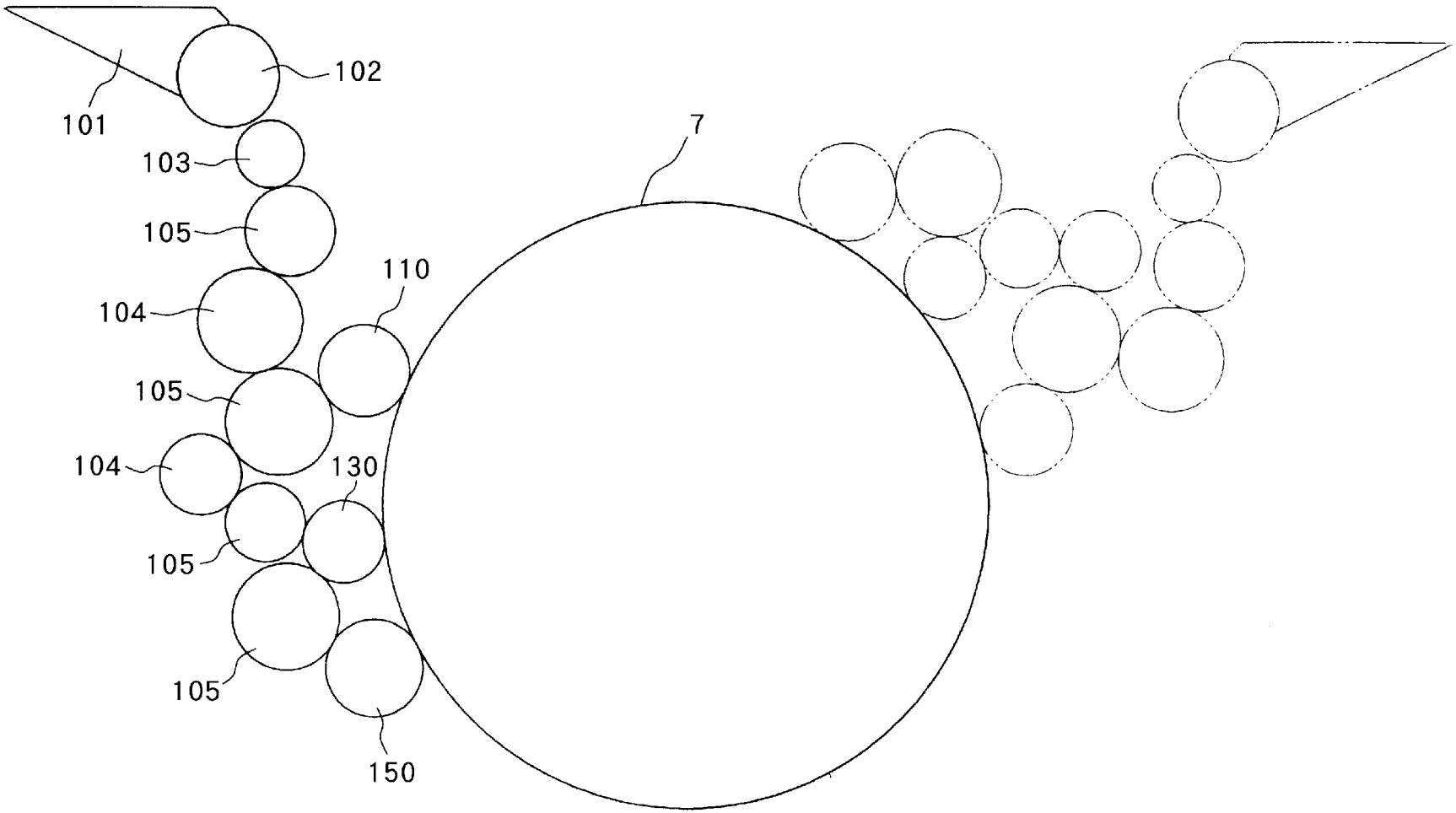
FIG. 2 is a schematic side view showing ink supply units and a plate cylinder according to the embodiment of the present invention.

Two sets of ink supply units 10 are disposed adjacent to each plate cylinder 7 for supplying inks of different colors to the first and second plate segments 7*a* and 7*b*. As shown in FIG. 2, each ink supply unit 10 includes first through third ink rollers 110, 130, 150 and an ink supply portion including an ink fountain 101, an ink fountain roller 102, an ink distribution roller 103, an ink form roller 104, and an ink oscillation roller 105, etc. The ink supply portion provides a fluid connection so as to deliver the ink in the ink fountain 101 to the ink rollers 110, 130, 150 through the order of the ink fountain roller 102, the ink distribution roller 103, the ink form roller 104, and the ink oscillation roller 105. Further, the ink rollers 110, 130, 150 are movable toward and away from the plate cylinder 7 to be in contact with or out of contact from the plate cylinder 7. Furthermore, the ink supply portion and the ink rollers 110, 130, 150 provide ink communication arrangement capable of maintaining ink communication from the ink fountain 101 to the ink rollers 110, 130, 150 even when the ink rollers are moved toward and away from the plate cylinder 7.

Next, moving mechanisms for moving the first, second and third ink rollers 110, 120, 130 into contact with the plate segment 7*a* and out of contact from the plate segment 7*b* of the plate cylinder 7 will be described with reference to FIGS. 3 through 6.

First Moving Mechanism

A first moving mechanism for moving the first ink roller 110 into contact with and out of contact from the plate cylinder 7 will be described.

A first ink roller support shaft 111 extends from the frame 11 (FIG. 5) in a direction parallel with the axial direction of the plate cylinder 7. A generally L-shaped first ink roller support arm 112 is provided pivotally movably about the first ink roller support shaft 111 for rotatably supporting the first ink roller 110. The first ink roller support arm 112 has a base end pivotally movable about the first ink roller support shaft 111, an intermediate bent portion rotatably supporting a first ink roller shaft 110*a* of the first ink roller 110, and a free end portion fixedly provided with a support rod 112*a* extending in the axial direction of the plate cylinder 7. A spring seat 11*a* is fixed to the frame 11, and first tension spring 114 is interposed between the spring seat 11*a* and the intermediate bent portion of the first ink roller support arm 112. Thus, the first ink roller support arm 112 is urged in a clockwise direction in FIG. 3 so that the first ink roller 110 is urged in a direction to contact with the plate cylinder 7. An adjustment collar 113 and a fixing nut 190 are provided in association with the support rod 112*a* for controlling a posture of the first ink roller support arm 112. That is, the adjustment collar 113 is generally cylindrical shape and is formed with a through hole at an eccentric position thereof, so that the support rod 112*a* extends through the through hole. Further, a hexagonal nut like protrusion 113*a* protrudes from one axial end of the adjustment collar 113 in a direction parallel with the axis of the plate cylinder 7. If the nut like protrusion 113*a* is rotated by applying and angularly moving a hexagonal wrench, the adjustment collar 113 can be rotated about an axis of the support rod 112*a*. The fixing nut 190 has a hexagonal shape and is formed with a central through hole through which the support rod 112*a* extends. The fixing nut 190 is adapted for fastening or releasing the adjustment collar 113 to and from the support rod 112*a*. Thus, by unfastening the fixing nut 190, the adjustment collar 113 can be eccentrically rotated about an axis of the support rod 112*a*, and by fastening the fixing nut 190, the adjustment collar 113 can be fixed to the support rod 112*a*. Accordingly, eccentrically rotational position of the adjustment collar 113 can be controlled.

Figure 3:
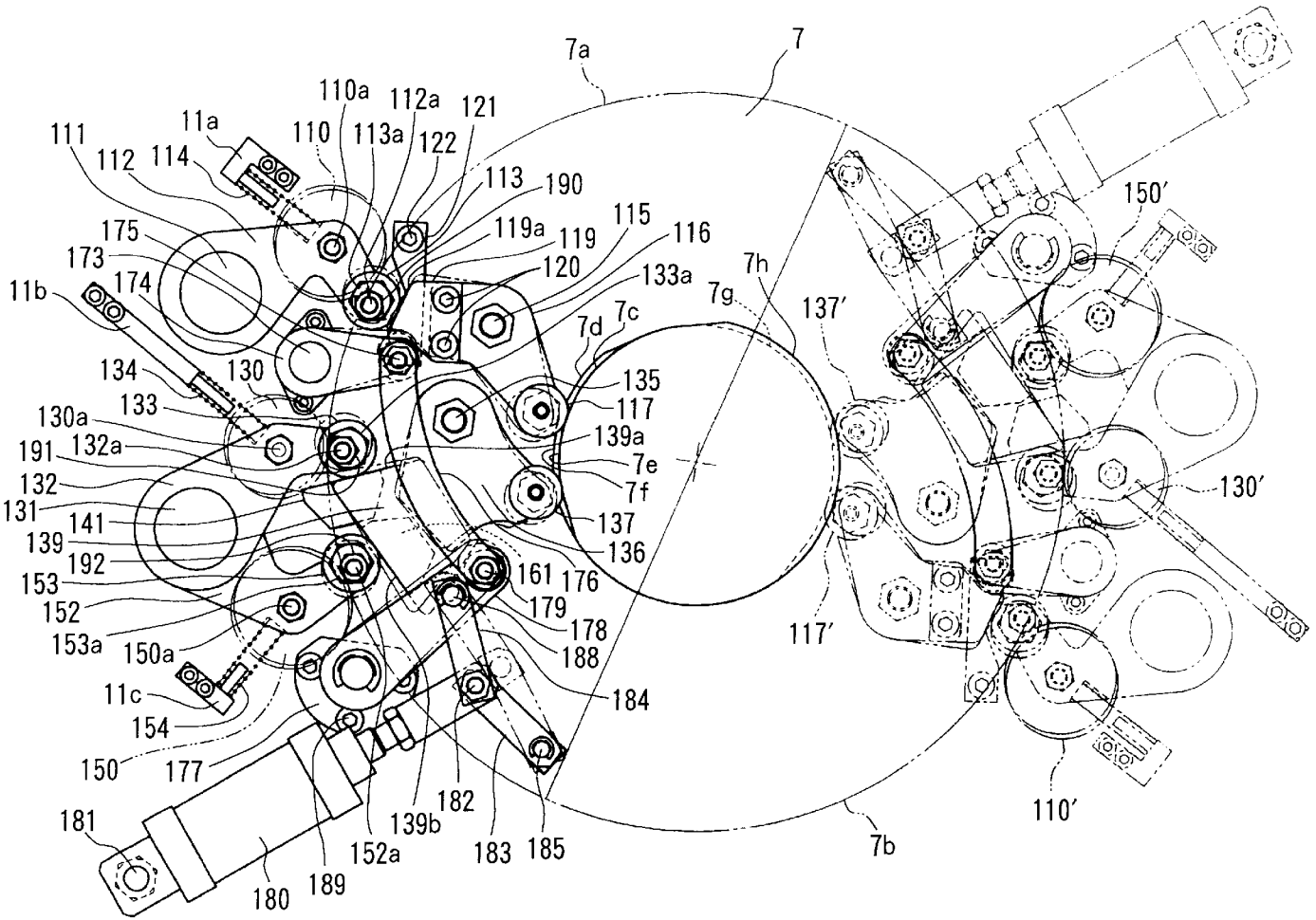
FIG. 3 is a side view showing a moving mechanism for moving ink rollers into contact with and out of contact from the plate cylinder according to the embodiment.

A generally cylindrical first and second center cams 7*c* and 7*d* are provided and coaxially With and integrally rotatable with the plate cylinder 7 as best shown in FIG. 3. The first and second cams 7*c* and 7*d* are positioned side by side in the axial direction of the plate cylinder 7 and beside the plate cylinder 7. The first cam 7*c* includes a radially shorter cam face 7*e* positioned at the first plate segment 7*a* (that is, the cam face 7*e* is positioned at the rotational phase equal to that of the first plate segment 7*a* ) and a radially longer cam face 7*h* positioned at the second plate segment 7*b* (that is, the cam face 7*h* is positioned at the rotational phase equal to that of the second plate segment 7*b* ). A radius of the shorter cam face 7*e* is smaller than that of the longer cam face 7*h*. The second cam 7*d* includes a radially shorter cam face 7*g* positioned at the second plate segment 7*b* and a radially longer cam face 7*f* positioned at the first plate segment 7*a*. A radius of the shorter cam face 7*g* is smaller than that of the longer cam face 7*f*.

A stud 115 extends from the frame 11 (FIG. 5) in a direction parallel with the axial direction of the plate cylinder 7 and at a position between the first ink roller support shaft 111 and the cams 7*c*, 7*d*, and an L-shaped arm 116 is pivotally supported by the stud 115. The L-shaped arm 116 has an intermediate bent portion supported rotatably about the stud 115, one end portion rotatably provided with a disc shaped cam follower 117, and another end portion fixedly provided with a cam member 119. More specifically, the one end portion of the L-shaped arm 116 has a bolt 118 (FIG. 5), and the cam follower 117 is provided rotatably about the bolt 118. The cam follower 117 is positioned to contact the radially shorter cam faces 7*e* and radially longer cam face 7*h* of the first cam 7*c* provided integrally with the plate cylinder 7. Two bolts 120, 120 extend through the other end portion of the L-shaped arm 116 to fix one end of the cam member 119. Thus, the cam member 119 is pivotally movable together with the L-shaped arm 116 about the stud 115. The cam member 119 has another end serving as a cam face 119*a* with which the adjustment collar 113 is urged to be contact.

By the biasing force of the first tension spring 114, the first ink roller 110, the first ink roller support arm 112, and the adjustment collar 113 are urged to be integrally moved in the clockwise direction in FIG. 3 about the first ink roller support shaft 111, so that the first ink roller 110 is urged to contact with the first plate segment 7*a* of the plate cylinder 7. At the same time, the adjustment collar 113 is urged to contact with the cam surface 119*a* of the cam member 119, so that the L-shaped arm 116 is urged to be pivotally moved about the stud 115 in the counterclockwise direction in FIG. 3. Thus, the cam follower 117 is urged to contact with the cam faces 7*e* and 7*h* of the first cam 7*c*.

The movement of the cam follower 117 is determinative by the contour of the cam faces 7*e* and 7*h*. If the cam follower 117 is in contact with the radially shorter cam face 7*e* positioned at the first plate segment 7*a*, the cam follower 117 is positioned closest to the axis of the plate cylinder 7. On the other hand, if the cam follower 117 is in contact with the radially longer cam face 7*h* positioned at the second plate segment 7*b*, the cam follower 117 is positioned farthest from the axis of the plate cylinder 7.

A generally M-shaped fixed cam 121 is positioned in superposed relation with the cam face 119*a*. More specifically, the fixed cam 121 is fixed to the frame 11 (FIG. 5) by a bolt 122 and at a position between the stud 115 and the first ink roller support shaft 111 in order to prevent the first ink roller 110 from being pressed against the plate cylinder 7 at a pressure higher than a predetermined pressure when the first ink roller support arm 112 is pivotally moved about the first ink roller support shaft 111 in the clockwise direction in FIG. 3. The adjustment collar 113 is positioned spaced away from the fixed cam 121 when the first ink roller support arm 112 is moved in the counterclockwise direction in FIG. 3 by the contact of the cam follower 117 with the radially longer cam face 7*h* of the first cam 7*c* and by the contact between the adjustment collar 113 and the cam face 119*a*. On the other hand, if the cam follower 117 is in contact with the radially shorter cam face 7*e* of the first cam 7*c*, the adjustment collar 113 is brought into abutment with the fixed cam 121, while the adjustment collar 113 is positioned spaced away from the cam face 119*a* of the cam member 119. That is, the abutment of the adjustment collar 113 onto the fixed cam 121 occurs when the adjustment collar 113 is moved toward the axis of the plate cylinder 7, and as a result, further pivotal movement of the first ink roller 110 toward the plate cylinder 7 can be prevented. Upon adjustment of the eccentrically rotational position of the adjustment collar 113 about the support rod 112*a* by employing the hexagonal wrench, a distance between the fixed cam 121 and the support rod 112*a* can be changed. Consequently, a distance between the axis of the plate cylinder 7 and the first ink roller shaft 110*a* of the first ink roller 110 can be changed, thereby controlling contacting pressure of the first ink roller 110 against the surface of the plate cylinder 7.

Second Moving Mechanism

A second moving mechanism for moving the second and third ink rollers 130, 150 into contact with and out of contact from the plate cylinder 7 will be described.

A second ink roller support shaft 131 extends from the frame 11 (FIG. 5) in a direction parallel with the axial direction of the plate cylinder 7. A distance between the second ink roller support shaft 131 and the axis of the plate cylinder 7 is approximately equal to a distance between the first ink roller support shaft 111 and the axis of the plate cylinder 7. A generally L-shaped second ink roller support arm 132 is provided pivotally movably about the second ink roller support shaft 131 for rotatably supporting the second ink roller 130. The second ink roller support arm 132 has a base end pivotally movable about the second ink roller support shaft 131, an intermediate bent portion rotatably supporting a second ink roller shaft 130*a* of the second ink roller 130, and a free end portion fixedly provided with a support rod 132*a* extending in the axial direction of the plate cylinder 7. A spring seat 11*b* is fixed to the frame 11, and a second tension spring 134 is interposed between the spring seat 11*b* and the intermediate bent portion of the second ink roller support arm 132. Thus, the second ink roller support arm 132 is urged in a clockwise direction in FIG. 3 so that the second ink roller 130 is urged in a direction to contact with the plate cylinder 7. An adjustment collar 133 and a fixing nut 191 are provided in association with the support rod 132*a* for controlling a posture of the second ink roller support arm 132. That is, the adjustment collar 133 is generally cylindrical shape and is formed with a through hole at an eccentric position thereof, so that the support rod 132*a* extends through the through hole. Further, a hexagonal nut like protrusion 133*a* protrudes from one axial end of the adjustment collar 133 in a direction parallel with the axis of the plate cylinder 7. If the nut like protrusion 133*a* is rotated by applying and angularly moving a hexagonal wrench, the adjustment collar 133 can be rotated about an axis of the support rod 132*a*. The fixing nut 191 has a hexagonal shape and is formed with a central through hole through which the support rod 132*a* extends. The fixing nut 191 is adapted for fastening or releasing the adjustment collar 133 to and from the support rod 132*a*. Thus, by unfastening the fixing nut 191, the adjustment collar 133 can be eccentrically rotated about an axis of the support rod 132*a*, and by fastening the fixing nut 191, the adjustment collar 133 can be fixed to the support rod 132*a*. Accordingly, the eccentrically rotational position of the adjustment collar 133 can be controlled.

A generally L-shaped third ink roller support arm 152 is also provided pivotally movably about the second ink roller support shaft 131 for rotatably supporting the third ink roller 150. The L-shaped third ink roller support arm 152 is separate from the L-shaped second ink roller support arm 132, and is configured symmetrically therewith with respect to an imaginary line directing to the axis of the plate cylinder 7 and passing through a diameter of the second ink roller support shaft 131. The third ink roller support arm 152 has a base end pivotally movable about the second ink roller support shaft 131, an intermediate bent portion rotatably supporting a third ink roller shaft 150*a* of the third ink roller 150, and a free end portion fixedly provided with a support rod 152*a* extending in the axial direction of the plate cylinder 7. A spring seat llc is fixed to the frame 11, and a third tension spring 154 is interposed between the spring seat 11*c* and the intermediate bent portion of the third ink roller support arm 152. Thus, the third ink roller support arm 152 is urged in a counterclockwise direction in FIG. 3 so that the third ink roller 150 is urged in a direction to contact with the plate cylinder 7. An adjustment collar 153 and a fixing nut 192 are provided in association with the support rod 152*a* for controlling a posture of the third ink roller support arm 152. That is, the adjustment collar 153 is generally cylindrical shape and is formed with a through hole at an eccentric position thereof, so that the support rod 152*a* extends through the through hole. Further, a hexagonal nut like protrusion 153*a* protrudes from one axial end of the adjustment collar 153 in a direction parallel with the axis of the plate cylinder 7. If the nut like protrusion 153*a* is rotated by applying and angularly moving a hexagonal wrench, the adjustment collar 153 can be rotated about an axis of the support rod 152*a*. The fixing nut 192 has a hexagonal shape and is formed with a central through hole through which the support rod 152*a* extends. The fixing nut 192 is adapted for fastening or releasing the adjustment collar 153 to and from the support rod 152*a*. Thus, by unfastening the fixing nut 192, the adjustment collar 153 can be eccentrically rotated about an axis of the support rod 152*a*, and by fastening the fixing nut 192, the adjustment collar 153 can be fixed to the support rod 152*a*. Accordingly, the eccentrically rotational position of the adjustment collars 153 can be controlled. This is similar to the adjustment collars 113, 133 for the first and second ink rollers 110, 130.

A stud 135 extends from the frame 11 (FIG. 5) in a direction parallel with the axial direction of the plate cylinder 7 and at a position between the first ink roller support shaft 111 and the cams 7*c*, 7*d*, and a generally trapezoidal arm 136 is pivotally supported by the stud 135. The trapezoidal arm 136 has a major side (corresponding to a lower bottom side of a trapezoid), a minor side (corresponding to an upper bottom side of the trapezoid) in parallel with the major side, and one and another corner portions at end portions of the major side. The one corner portion is supported rotatably about the stud 135, and another corner portion is rotatably provided with a disc shaped cam follower 137. The minor side is fixedly provided with a trapezoidal cam member 139. More specifically, the one corner portion of the trapezoidal arm 136 has a bolt 138 (FIG. 5), and the cam follower 137 is provided rotatably about the bolt 138. The cam follower 137 is positioned to contact the radially shorter cam faces 7*e* and radially longer cam face 7*h* of the first cam 7*c* similar to the cam follower 117. Two bolts 140, 140 (FIG. 5) extend through the trapezoidal arm 136 adjacent the minor side to fix a minor side of the trapezoidal cam member 139. Thus, the cam member 139 is pivotally movable together with the trapezoidal arm 136 about the stud 135. The cam member 139 has a major side face serving as a cam face 139*b* with which the adjustment collar 153 for the third ink roller 150 is urged to be contact. Further, the cam member 139 has a slant side face 139*a* with which the adjustment collar 133 for the second ink roller 130 is urged to be contact.

By the biasing force of the second tension spring 134, the second ink roller 130, the second ink roller support arm 132, and the adjustment collar 133 are urged to be integrally moved in the clockwise direction in FIG. 3 about the second ink roller support shaft 131, so that the second ink roller 130 is urged to contact with the first plate segment 7*a* of the plate cylinder 7. Further, by the biasing force of the third tension spring 154, the third ink roller 150, the third ink roller support arm 152, and the adjustment collar 153 are urged to be integrally moved in the counterclockwise direction in FIG. 3 about the second ink roller support shaft 131, so that the third ink roller 150 is urged to contact with the first plate segment 7*a* of the plate cylinder 7. In synchronization with the contact of the second and third ink rollers 130, 150 with the first plate segment 7*a* of the plate cylinder 7, the adjustment collars 133, 153 are brought into abutment with the cam faces 139*a* and 139*b*, respectively, and the cam member 139 are pressed by the adjustment collars 133, 153. Therefore, the trapezoidal arm 136 is urged to be pivotally moved about the stud 135 in the counterclockwise direction in FIG. 3. Thus, the cam follower 137 is urged to contact with the cam faces 7*e* and 7*h* of the first cam 7*c*.

Similar to the cam follower 117, the movement of the cam follower 137 is determinative by the contour of the cam faces 7*e* and 7*h*. If the cam follower 137 is in contact with the radially shorter cam face 7*e* positioned at the first plate segment 7*a*, the cam follower 137 is positioned closest to the axis of the plate cylinder 7. On the other hand, if the cam follower 137 is in contact with the radially longer cam face 7*h* positioned at the second plate segment 7*b*, the cam follower 137 is positioned farthest from the axis of the plate cylinder 7.

A generally trapezoidal fixed cam 141 is positioned at a superposed relation with the cam face 139*a*. More specifically, the fixed cam 141 is fixed to the frame 11 (FIG. 5) by a bolt 142 at a position between the stud 135 and the second ink roller support shaft 131 in order to prevent the second ink roller 130 from being pressed against the plate cylinder 7 at a pressure higher than a predetermined pressure when the second ink roller support arm 132 is pivotally moved about the second ink roller support shaft 131 in the clockwise direction in FIG. 3. Further, a generally trapezoidal fixed cam 161 is positioned at a superposed relation with the cam face 139*b*. More specifically, the fixed cam 161 is fixed to the frame 11 (FIG. 5) by a bolt 162 at a position between the stud 135 and the second ink roller support shaft 131 and adjacent the fixed cam 41 in order to prevent the third ink roller 150 from being pressed against the plate cylinder 7 at a pressure higher than a predetermined pressure when the third ink roller support arm 152 is pivotally moved about the second ink roller support shaft 131 in the counterclockwise direction in FIG. 3.

The adjustment collars 133 and 153 are moved spaced away from the fixed cams 141, and 161, respectively, when the second ink roller support arm 132 is moved in the counterclockwise direction in FIG. 3 and the third ink roller support arm 152 is moved in the clockwise direction in FIG. 3 by the contact of the cam follower 137 with the radially longer cam face 7*h* of the first cam 7*c* and by the contact between the adjustment collars 133, 153 and the cam faces 139*a*, 139*b*. On the other hand, if the cam follower 137 is in contact with the radially shorter cam face 7*e* of the first cam 7*c*, the adjustment collars 133, 153 are brought into abutment with the respective fixed cam 141, 161 while the adjustment collars 133, 153 are positioned spaced away from the cam faces 139*a*, 139*b* of the cam member 139. That is, the abutment of the adjustment collar 133, 153 onto the fixed cams 141, 161 occurs when the adjustment collars 133, 153 are moved toward the axis of the plate cylinder 7, and as a result, further pivotal movement of the second and third ink rollers 130, 150 toward the plate cylinder 7 can be prevented. Upon adjustment of the eccentrically rotational positions of the adjustment collars 133 and 153 about the support rod 132*a*, 152*a* by employing the hexagonal wrench, a distance between the fixed cam 141, 161 and the support rod 132*a*, 152*a* can be changed. Consequently, a distance between the axis of the plate cylinder 7 and the second and third ink roller shafts 130*a*, 150*a* of the second and third ink rollers 130, 150 can be changed, thereby controlling contacting pressure of the second and third ink rollers 130, 150 against the surface of the plate cylinder 7.

Next, movement of the first, second and third ink rollers 110, 130, 150 into contact with and out of contact from the plate cylinder 7 will be described. When the cam followers 117, 137 are in contact with the radially shorter cam face 7*e* of the first cam 7*c* of the first plate segment 7*a* as shown by a solid line in FIG. 3, the L-shaped arm 116 and the trapezoidal arm 136 are in the postures as a result of counterclockwise pivotal motion of these arms 116, 136 about the studs 115 and 135, respectively. In this case, the cam members 119 and 139 are also moved in the counterclockwise direction together with the movement of the arms 116, 136, so that the adjustment collars 113, 133 are moved in the clockwise direction about the first ink roller support shaft 111 and the second ink roller support shaft 131, respectively, and the adjustment collar 153 is moved in the counterclockwise direction about the second ink roller support shaft 131. At the same time, the first and second ink rollers 110 and 130 are also pivotally moved in the clockwise direction about the shafts 111, and 131, and the third ink roller 150 is pivotally moved in the counterclockwise direction about the shaft 131. Thus, the first through third ink rollers 110, 130, 150 are brought into contact with the surface of the plate cylinder 7. In this case, the adjustment collars 113, 133, 153 are brought into abutment with the respective fixed cams 121, 141, 161, since the distances between the rotation axes of the adjustment collars 113, 133, 153 and the respective cam faces 1119*a*, 139*a*, 139*b* are greater than the distances between the rotation axes of the adjustment collars 113, 133, 153 and the fixed cams 121, 141, 161. Consequently, contacting pressure of the first through third ink rollers 110, 130, 150 against the plate cylinder 7 can be restrained to a predetermined pressure.

When the cam followers 117, 137 are in contact with the radially longer cam face 7*h* of the first cam 7*c* at the second plate segment 7*b* of the plate cylinder 7 as shown by a two dotted chain line in FIG. 3, the L-shaped arm 116 and the trapezoidal arm 136 are in the postures as a result of clockwise pivotal motion of these arms 116, 136 about the studs 115 and 135, respectively. In this case, the cam members 119 and 139 are also moved in the clockwise direction together with the movement of the arms 116, 136, so that the cam members 119, 139 are brought into abutment with the adjustment collars 113, 133, 153. In accordance with the pivotal motion of the cam members 119, 139, the adjustment collars 113, 133 are moved in the counterclockwise direction about the first ink roller support shaft 111 and the second ink roller support shaft 131, respectively, and the adjustment collar 153 is moved in the clockwise direction about the second ink roller support shaft 131. At the same time, the first and second ink rollers 110 and 130 are also pivotally moved in the counterclockwise direction about the shafts 111, and 131, and the third ink roller 150 is pivotally moved in the clockwise direction about the shaft 131. Thus, the first through third ink rollers 110, 130, 150 are out of contact from the surface of the plate cylinder 7.

Because of the above described first and second moving mechanisms including the first cam 7*c*, the first through third ink rollers 110, 130, 150 can surely be brought into contact with only the first plate segment 7*a* at the surface of the plate cylinder 7, and further, these first through third ink rollers 110, 130, 150 can surely be out of contact from the second plate segment 7*b* of the plate cylinder 7. Further, the contact timing and contacting period of the first and second ink rollers 110 and 130 with respect to the first plate segment 7*a* of the plate cylinder 7 can be determined by the geometrical relationship between the cam followers 117, 137 and the cam face of the first cam 7*c*. That is, the contact can be started when a leading end of the first plate segment 7*a* reaches the respective ink rollers 110, 130, and the out of contact can be started when a trailing end of the first plate segment 7*a* reaches the respective ink rollers 110, 130. Accordingly, the ink rollers 110 and 130 can be in contact with the first plate segment 7*a* at the condition and the period equal to each other, and as a result, uniform ink density can be provided with respect to an entire region of the first plate segment 7*a*. The same is true with respect to the first and third ink rollers 110 and 150 relative to the first plate segment 7*a*.

The above description pertains to the first through third ink rollers 110, 130, 150 which are in contact with the first plate segment 7*a* and out of contact from the second plate segment 7*b*. Further, another set of ink rollers 110', 130' and 150' and associated moving mechanism are provided at diametrically opposite side of the plate cylinder 7. These rollers 110', 130' and 150' and their moving mechanism provide the structures the same as the above described rollers 110, 130, 150 and their moving mechanisms except that (a) the ink rollers 110', 130', 150' are in contact with the second plate segment 7*b* and out of contact from the first plate segment 7*a*, and (b) cam followers 117' and 137' corresponding to the above described cam followers 117 and 137 are in contact with and moved by the second cam 7*d* positioned axially beside the first cam 7*c*. That is, the cam followers 117' and 137' are in successive contact with the radially longer cam face 7*f* and the radially shorter cam face 7*g* of the second cam 7*d*.

Interlocking Mechanism

Figure 4:
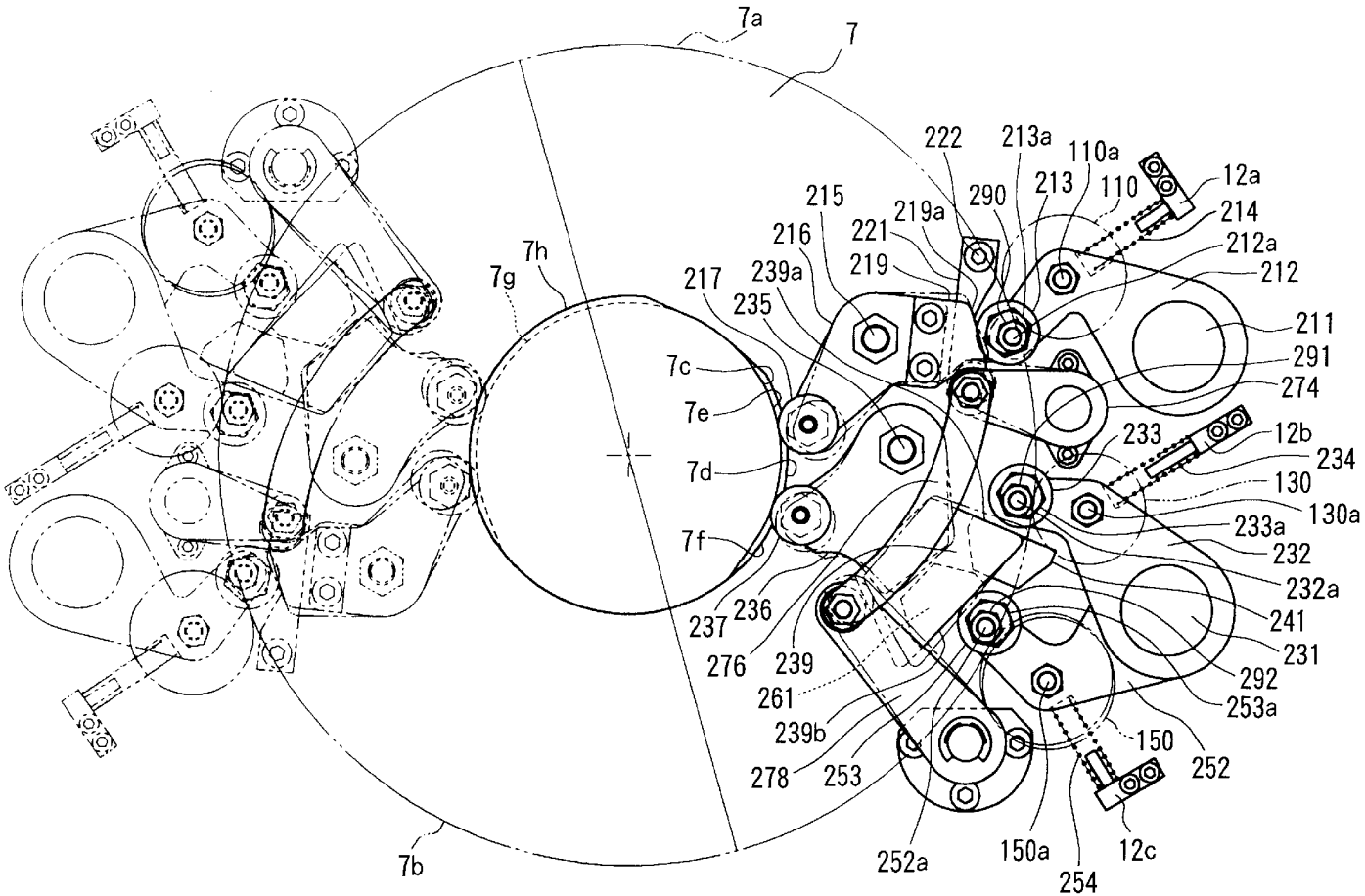
FIG. 4 is a side view as viewed from a side opposite to the view of FIG. 3 showing the moving mechanism according to the embodiment.
Figure 5:
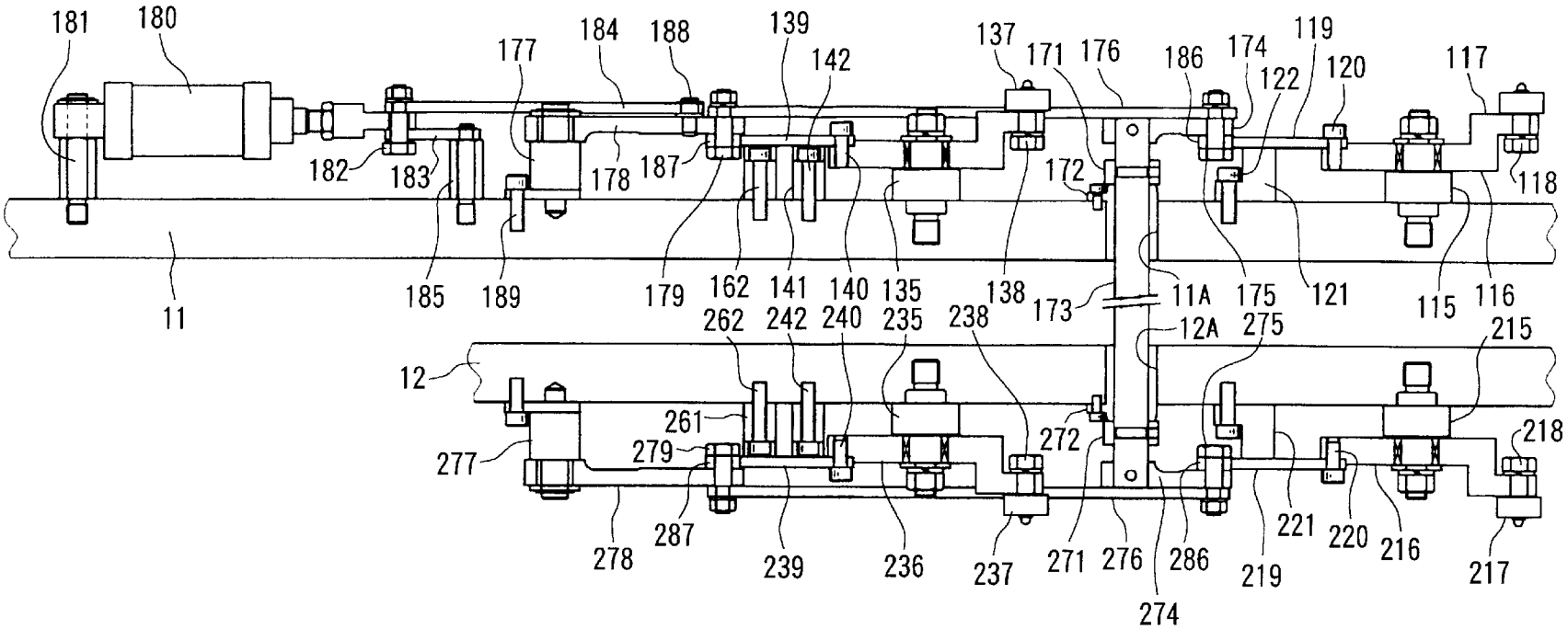
FIG. 5 is an explanatory diagram showing the moving mechanism according to the embodiment.
Figure 6:
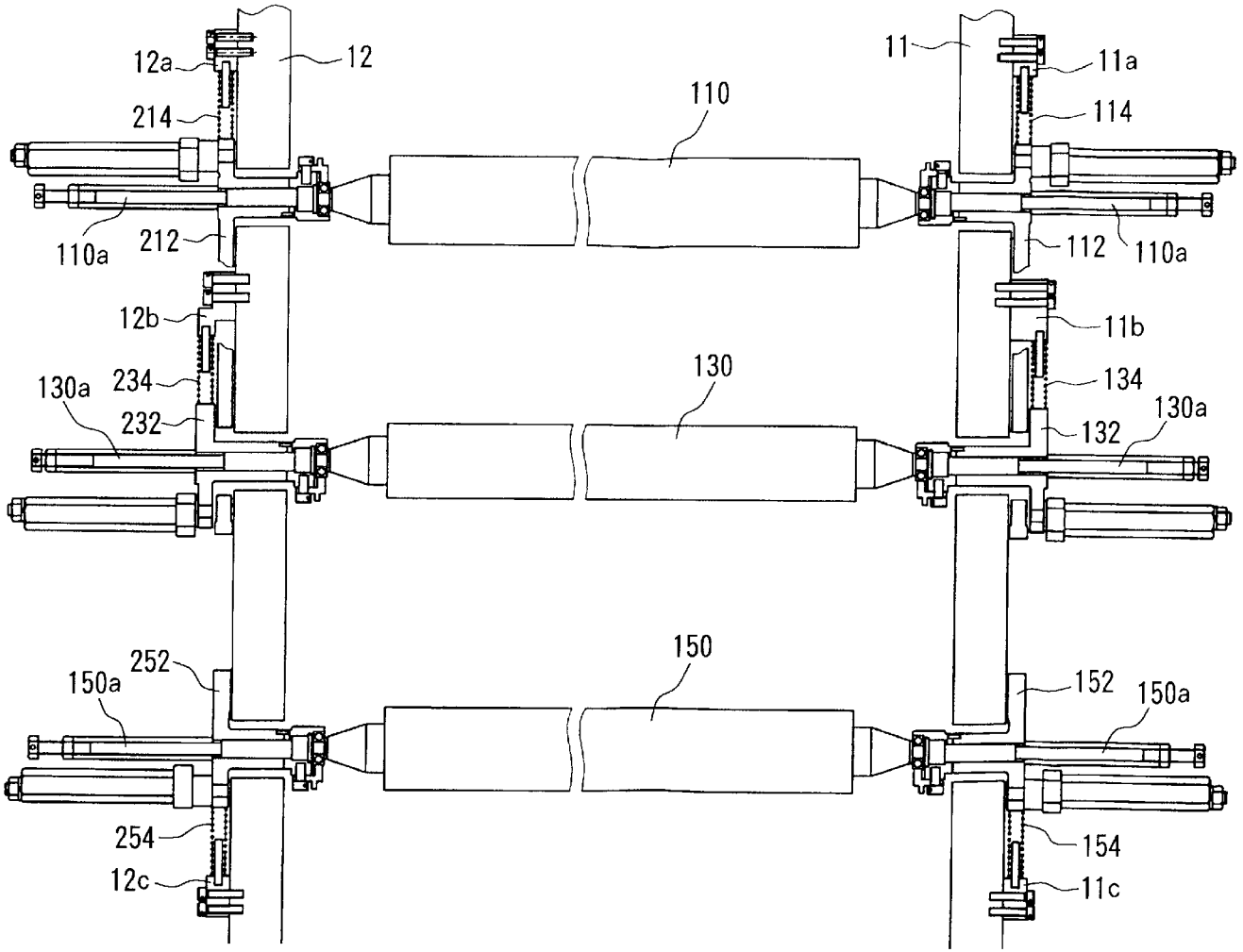
FIG. 6 is a plan view showing the ink rollers and the moving mechanism according to the embodiment.

An interlocking mechanism will next be described with reference to FIGS. 3 through 5. The interlocking mechanism is adapted for concurrently moving the above-described first and second moving mechanisms in order to concurrently move the first through third ink rollers 110, 130, 150 into contact with and out of contact from the plate cylinder 7. This concurrent movement is particularly effective to stop ink supply to the plate cylinder 7.

The frame 11 is formed with a cylindrical through hole 11A (FIG. 5) at a position between the first ink roller support shaft 111 and the stud 135. A frame 12 extending in parallel with the frame 11 is also formed with a cylindrical through hole 12A in axial alignment with the through hole 11A. A bushing 172 is fitted in the through hole 11A for rotatably supporting a shaft 173, and a stop collar 171 is fixed to the shaft 173 by a screw. Similarly, a bushing 272 is fitted in the through hole 12A for rotatably supporting the shaft 173, and a stop collar 271 is fixed to the shaft 173 by a screw. At the side of the frame 11, the shaft 173 has one distal end where one end portion of an arm member 174 (FIGS. 3 and 5) is fixed. Similarly at the side of the frame 12, the shaft 173 has another distal end where one end portion of an arm member 274 (FIGS. 4 and 5) is fixed. The arm member 174 extends from the shaft 173 toward the axis of the plate cylinder 7. The arm member 174 has another end portion provided with a pin 175 to which an one end portion of an arcuate link 176 is pivotally connected. The arcuate link 176 extends in a generally circumferential direction of the plate cylinder 7. Further, a roller 186 is rotatably supported to the other end portion of the arm member 174 by the pin 175. The roller 186 is so positioned abuttable on the cam member 119.

One end of a stud 177 extending in the axial direction of the plate cylinder 7 is fixed to the frame 11 by a bolt 189 at a position offset from the second ink roller support shaft 131 toward the counterclockwise direction in FIG. 3 with respect to the axis of the plate cylinder 7. Another end of the stud 177 rotatably connects one end portion of an arm member 178 (FIGS. 3 and 5). The arm member 178 extends from the stud 177 toward the axis of the plate cylinder 7. The arm member 178 has another end portion provided with a pin 179 to which another end portion of the arcuate link 176 is pivotally connected. Further, a roller 187 (FIG. 5) is rotatably supported to the other end portion of the arm member 178 by the pin 179. The roller 187 is so positioned abuttable on the cam member 139.

One end of a pneumatic cylinder 180 is pivotally movably connected to the frame 11 by a pin 181 at a position offset from the stud 177 toward the counterclockwise direction in FIG. 3 with respect to the axis of the plate cylinder 7. Another end of the pneumatic cylinder 180 is provided with a pin 182 to which a generally rectangular link 183 and an interlocking link 184 are pivotally movably connected. That is, the link 183 has one end pivotally movably connected to the frame 11 by a stud 185 and another end pivotally movably connected to the pin 182, and the interlocking link 184 has one end pivotally movably connected to the pin 182 and another end pivotally movably connected to the arm member 178 by a pin 188 positioned at an intermediate portion of the arm member 178 and close to the pin 179.

Operation of the interlocking mechanism will cause simultaneous movement of the first through third ink rollers 110, 130, 150 toward and away from the surface of the plate cylinder 7 in accordance with the actuation of the pneumatic cylinder 180. More specifically, In non-actuating state of the pneumatic cylinder 180, generally V shaped configuration is provided by the two links 183 and 184 as shown by a soloid line in FIG. 3. In this state, the arm member 178 is pivotally moved in the clockwise direction in FIG. 3 about the stud 177. Therefore, the arcuate link 176 is moved in the counterclockwise direction about the axis of the plate cylinder 7, and the arm member 174 is pivotally moved in the clockwise direction in FIG. 3 about the shaft 173. Accordingly, the rollers 186 and 187 are moved away from the cam members 119, and 139, respectively. Thus, these rollers 186 and 187 do not push the cam members 119 139. Consequently, the first ink roller 110 is brought into contact with or out of contact from the plate cylinder 7 independently of the contact and out of contact motion of the second and third ink rollers 130, 150 only through the first and second moving mechanisms.

Upon actuation of the pneumatic cylinder 180, a generally linear alignment can be provided by the links 183 and 184 as shown by two dotted chain line in FIG. 3. In this state, the arm member 178 is pivotally moved in the counterclockwise direction in FIG. 3 about the stud 177. Therefore, the arcuate link 176 is moved in the clockwise direction about the axis of the plate cylinder 7, and the arm member 174 is pivotally moved in the counterclockwise direction in FIG. 3 about the shaft 173. Accordingly, the rollers 186 and 187 are moved in the clockwise direction about the axis of the plate cylinder 7, so that these rollers 186, 187 are brought into abutment with the cam members 119, 139, respectively. As a result, these cam members 119, 139 are moved in the clockwise direction in FIG. 3 about the studs 115, 135, respectively because of the urging force from the rollers 186, 187. Pivotally moving strokes of the cam members 119 and 139 is the same as those provided by the contact of the cam followers 177, 137 with the radially longer cam face 7*h* of the first cam 7*c*. Because of the concurrent movement of the cam members 119 and 139, the first through third ink rollers 110, 130, 150 are concurrently moved away from the surface of the plate cylinder 7.

The above description pertains to the interlocking mechanism at the side of the frame 11. The relevant mechanism is symmetrically provided at the side of the frame 12 extending in parallel with the frame 11 except that no components are provided corresponding to the pneumatic cylinder 180, the pins 181, 182, the links 183, 184 and the stud 185 at the side of the frame 12. However, an arm 274 (corresponding to the arm 174), an arcuate link 276 (corresponding to the arcuate link 176), and an arm 278 (corresponding to the arm 178) can be moved, since the pivotal movement of the arm 174 causes rotation of the shaft 173 about its axis, so that the arm 274 can be pivotally moved about an axis of the shaft 173. The pivotal motion of the arm 274 causes concurrent movement of the arcuate link 276 and the arm 278. Incidentally, components at the side of the frame 11 are designated by the reference numerals in the 100's, and components at the side of the frame 12 and corresponding to the components at the side of the frame 11 are designated by the reference numerals in the 200's.

In order to stop ink supply to the plate cylinder 7, the first through third ink rollers 110, 130, 150 must be simultaneously moved out of contact from the plate cylinder 7. In the above described embodiment, the rollers 186, 187 provided at both ends of the arcuate link 176 interlockingly move the cam member 119 and the cam member 139, in which the cam member 119 moves the first ink roller 110 into contact with and out of contact from the plate cylinder 7 and the cam member 139 moves the second and third ink roller 130,150 into contact with and out of contact from the plate cylinder 7. Therefore, the first through third ink rollers 110, 130, 150 can be concurrently moved out of contact from the plate cylinder 7 without any additional or separate mechanical arrangement. Thus, the offset printer can be produced at low cost.

While the invention has been described in detail with reference to the specific embodiment thereof, it would be apparent to those skilled in the art that various changes and modifications may be made therein without departing from the spirit and scope of the invention. For example, in the above described embodiment, the pneumatic cylinder 180 is provided at the frame 11 only. However, additional pneumatic cylinder can be provided at the frame 12 so as to concurrently move the arms 178 and 278. Further, a digital type or non digital type offset printer is available in the present invention. Furthermore, the depicted embodiment provides four the ink supply units for printing with four ink color. However, the number of the ink supply unit is not limited to four. Furthermore, images can be directly formed over the outer peripheral surface of the plate cylinder 7, or a thin plate can be formed over the outer peripheral surface of the plate cylinder 7, and the thin plate is sectioned into a plurality of plate segments.

What is claimed is:

1. An offset printer comprising:

a frame;

a plate cylinder rotatably supported by the frame and having a peripheral surface sectioned into at least two plate segments extending between ends of the plate cylinder;

a plurality of ink supply units each supplying a different colored ink, the ink supply units being provided in one-to-one correspondence with the plate segments, and each ink supply unit including an ink roller contactable with its corresponding plate segment so that the at least two plate segments receive inks of different colors; and a moving mechanism provided for each ink supply unit and supported on the frame and connected to the ink roller of each ink supply unit for moving the ink roller into contact with the corresponding plate segment and for moving the ink roller out of contact from each non corresponding plate segment, wherein the at least two plate segments include a first plate segment having a semicircular cross-section and a second plate segment having a remaining semicircular cross-section, and wherein the moving mechanism comprises:

a support arm pivotally movably supported on the frame and rotatably supporting the ink roller, a pivotal movement of the support arm moving the ink roller into contact with and out of contact from the plate cylinder;

a cam member pivotally movably supported on the frame and having one end contactable with the support arm and another end provided with a cam follower, a pivotal movement of the cam member pivotally moving the support arm; and a generally circular center cam disposed coaxially with the plate cylinder and positioned therebeside, the circular center cam comprising a first radius cam face provided at a rotation phase equal to the first plate segment, and a second radius cam face having a radius different from the first radius and provided at a rotation phase equal to the second plate segment, the cam follower being in contact with the first radius cam face for contacting the ink roller with the first plate segment, and the cam follower being in contact with the second radius cam face for moving the ink roller out of contact from the second plate segment.

2. The offset printer as claimed in claim 1, wherein the support arm is biased in a direction to move the ink roller toward the plate cylinder, and wherein the moving means further comprises restraining means for restraining excessive contacting pressure of the ink roller against the plate cylinder.

3. The offset printer as claimed in claim 2, wherein the restraining means comprises a fixed cam fixed to the frame and disposed in superposed relation to the one end of the cam member, the support arm being abutable on the fixed cam and spaced away from the one end of the cam member when the cam follower is in rolling contact with the first radius cam face.

4. The offset printer as claimed in claim 3, further comprising adjusting means for adjusting contacting pressure of the ink roller against the plate cylinder, the adjusting means being disposed at the support arm and positioned in confrontation with the fixed cam.

5. The offset printer as claimed in claim 4, wherein the adjusting means comprises an adjustment collar provided at the support arm, the adjustment collar being eccentrically rotatable and abutable on the fixed cam and spaced away from the one end of the cam member when the cam follower is in rolling contact with the first radius cam face, the eccentrical rotational position of the adjustment collar determining a contacting pressure of the ink roller against the first plate segment, the adjustment collar being also abuttable on the one end of the cam member when the cam follower is in contact with the second radius cam face.

6. An offset printer comprising:

a frame;

a plate cylinder rotatably supported by the frame and having a peripheral surface sectioned into at least two plate segments extending between ends of the plate cylinder;

a plurality of ink supply units each supplying a different colored ink, the ink supply units being provided in one-to-one correspondence with the plate segments, and each ink supply unit including an ink roller contactable with its corresponding plate segment so that the at least two plate segments receive inks of different colors; and a moving mechanism provided for each ink supply unit and supported on the frame and connected to the ink roller of each ink supply unit for moving the ink roller into contact with the corresponding plate segment and for moving the ink roller out of contact from each non corresponding plate segment, wherein each ink supply unit comprises at least two ink rollers including a first ink roller and a second ink roller, and wherein the moving means comprises different timing means for providing an out of contacting timing of the first ink roller from the corresponding plate segment different from an out of contact timing of the second ink roller from the corresponding plate segment, and for providing a contacting timing of the first ink roller with the corresponding plate segment different from a contact timing of the second ink roller with the corresponding plate segment.

7. The offset printer as claimed in claim 6, wherein the at least two plate segments include a first plate segment having a semi-circular cross-section and a second plate segment having a remaining semi-circular cross-section;

and wherein the moving means further comprises:

a first support arm pivotally movably supported on the frame and rotatably supporting the first ink roller, a pivotal movement of the first support arm moving the first ink roller into contact with and out of contact from the plate cylinder;

a second support arm positioned spaced away from the first support arm in a circumferential direction of the plate cylinder, the second support arm being pivotally movably supported on the frame and rotatably supporting the second ink roller, a pivotal movement of the second support arm moving the second ink roller into contact with and out of contact from the plate cylinder;

and wherein different timing means comprises:

a first cam member pivotally movably supported on the frame and having one end contactable with the first support arm and another end provided with a first cam followr, a pivotal movement of the first cam member pivotally moving the first support arm; and a second cam member pivotally movably supported on the frame and having one end contactable with the second support arm and another end provided with a second cam follower, a pivotal movement of the second cam member pivotally moving the second support arm; and a generally circular center cam disposed coaxially with the plate cylinder and positioned therebeside, the circular center cam comprising a first radius cam face provided at a rotation phase equal to the first plate segment, and a second radius cam face having a radius different from the first radius and provided at a rotation phase equal to the second plate segment, the first and second cam followers being in successive rolling contact with the first radius cam face for successively contacting the first and second ink rollers with the first plate segment, and the first and second cam followers being in successive rolling contact with the second radius cam face for successively moving the first and second ink rollers out of contact from the second plate segment.

8. The offset printer as claimed in claim 7, wherein the first support arm has a base end pivotally movably supported to the frame, an intermediate portion rotatably supporting the first ink roller and a free end portion abutable on the one end of the first cam member;

and wherein the second support arm has a base end pivotally movably supported to the frame, an intermediate portion rotatably supporting the second ink roller and a free end portion abutable on the one end of the second cam member.

9. The offset printer as claimed in claim 8, further comprising restraining means for restraining excessive contacting pressure of the first and second ink rollers against the plate cylinder.

10. The offset printer as claimed in claim 9, wherein the restraining means comprises:

a first fixed cam fixed to the frame and disposed in superposed relation to the one end of the first cam member, the free end portion of the first support arm being abutable on the first fixed cam and spaced away from the one end of the first cam member when the first cam follower is in rolling contact with the first radius cam face; and a second fixed cam fixed to the frame and disposed in superposed relation to the one end of the second cam member, the free end portion of the second support arm being abutable on the second fixed cam and spaced away from the one end of the second cam member when the second cam follower is in rolling contact with the first radius cam face.

11. The offset printer as claimed in claim 10, further comprising adjusting means for adjusting contacting pressure of the first and second ink rollers against the plate cylinder.

12. The offset printer as claimed in claim 11, wherein the adjusting means comprises:

a first adjustment collar provided at the free end of the first support arm, the adjustment collar being eccentrically rotatable and abutable on the first fixed cam and spaced away from the one end of the first cam member when the first cam follower is in rolling contact with the first radius cam face, the eccentrical rotational position of the first adjustment collar determining a contacting pressure of the first ink roller against the first plate segment, the first adjustment collar being also abuttable on the one end of the cam member when the first cam follower is in contact with the second radius cam face; and a second adjustment collar provided at the free end of the second support arm, the second adjustment collar being eccentrically rotatable and abutable on the second fixed cam and spaced away from the one end of the second cam member when the second cam follower is in rolling contact with the first radius cam face, the eccentrical rotational position of the second adjustment collar determining a contacting pressure of the second ink roller against the first plate segment, the second adjustment collar being also abuttable on the one end of the second cam member when the second cam follower is in contact with the second radius cam face.

13. The offset printer as claimed in claim 12, further comprising an interlocking mechanism for simultaneously moving the first and second ink rollers out of contact from the corresponding plate segment in case of a stop of supply of ink to the corresponding plate segment, and for simultaneously moving the first and second ink rollers toward the corresponding plate segment.

14. The offset printer as claimed in claim 13, wherein the interlocking mechanism comprises:

a drive source;

a first arm member pivotally supported to the frame and having a free end;

a second arm member pivotally supported to the frame and having a free end;

a link member having one end pivotally connected to the free end of the first arm and abuttable on the one end of the first cam member and another end pivotally connected to the free end of the second arm and abuttable on the one end of the second cam member; and a link set connected between the drive source and the one of the first and the second arm members, the drive source causing movement of the link set to move the link member for concurrently pushing and moving the one end of the first cam member and the one end of the second cam member, whereby the first and second support arms are pivoted concurrently to move the first and second ink rollers away from the plate cylinder.

15. An offset printer comprising:

a frame;

a plate cylinder rotatably supported by the frame and having a peripheral surface sectioned into at least two plate segments extending between ends of the plate cylinder;

a plurality of ink supply units each supplying a different colored ink, the ink supply units being provided in one-to-one correspondence with the plate segments, and each ink supply unit including an ink roller contactable with its corresponding plate segment so that the at least two plate segments receive inks of different colors; and a moving mechanism provided for each ink supply unit and supported on the frame and connected to the ink roller of each ink supply unit for moving the ink roller into contact with the corresponding plate segment and for moving the ink roller out of contact from each non corresponding plate segment, wherein each ink supply unit comprises a plurality of ink rollers, and the offset printer further comprising an interlocking mechanism for simultaneously moving the plurality of ink rollers out of contact from the corresponding plate segment in case of a stop of supply of ink to the corresponding plate segment, and for simultaneously moving the plurality of ink rollers toward the corresponding plate segment.

* * * * *